US006709079B1

(12) United States Patent
Feltrin

(10) Patent No.: US 6,709,079 B1
(45) Date of Patent: Mar. 23, 2004

(54) SUPPORTING STRUCTURES OF MODULAR FURNITURE

(75) Inventor: Maurizio Feltrin, Codogne-Treviso (IT)

(73) Assignee: Comprex SPA, Codogne-Treviso (IT)

( * ) Notice: Subject to any disclaimer, the term of this patent is extended or adjusted under 35 U.S.C. 154(b) by 0 days.

(21) Appl. No.: 09/889,109

(22) PCT Filed: Jan. 3, 2000

(86) PCT No.: PCT/IB00/00005

§ 371 (c)(1),
(2), (4) Date: Jul. 11, 2001

(87) PCT Pub. No.: WO00/41594

PCT Pub. Date: Jul. 20, 2000

(30) Foreign Application Priority Data

Jan. 11, 1999 (IT) ..... BO99A0009

(51) Int. Cl.[7] ..... A47B 53/00
(52) U.S. Cl. ..... 312/205; 312/198
(58) Field of Search ..... 312/107, 111, 312/198, 203, 205; 108/102, 137

(56) References Cited

U.S. PATENT DOCUMENTS

| | | | | | |
|---|---|---|---|---|---|
| 1,700,202 | A | * | 1/1929 | Langford | 312/203 |
| 1,928,936 | A | * | 10/1933 | Henricson | 312/205 |
| 4,390,217 | A | * | 6/1983 | Wagner | 312/205 |
| 5,303,057 | A | * | 4/1994 | Davidow et al. | 312/205 |
| 5,435,644 | A | * | 7/1995 | Schuh et al. | 312/205 |
| 5,794,794 | A | | 8/1998 | Hull | |
| 5,795,041 | A | | 8/1998 | Weaver | |
| 6,017,104 | A | * | 1/2000 | Foschino | 312/205 |

FOREIGN PATENT DOCUMENTS

| | | | | |
|---|---|---|---|---|
| DE | 3827574 | * | 3/1989 | 312/205 |
| DE | 3838525 | * | 3/1990 | 312/205 |
| DE | 29603227 | | 8/1996 | |
| FR | 2703226 | * | 10/1994 | 312/205 |

* cited by examiner

*Primary Examiner*—Janet M. Wilkens
*Assistant Examiner*—Hanh V. Tran

(57) ABSTRACT

Improvements to modular furniture systems comprising furniture modules and a support structure. The support structure comprises vertical jambs. The jambs are connected by a top horizontal panel and by a bottom panel as well as by a plurality of intermediate horizontal elements located at respective heights intermediate said top and bottom elements. The intermediate horizontal elements are adapted in stiffness and bending resistance so as to support at least one furniture module. Each constituent furniture module is hung directly on a respective one of the intermediate horizontal elements.

4 Claims, 4 Drawing Sheets

SUPPORTING STRUCTURES OF MODULAR FURNITURE

TECHNICAL FIELD

Figure 1:
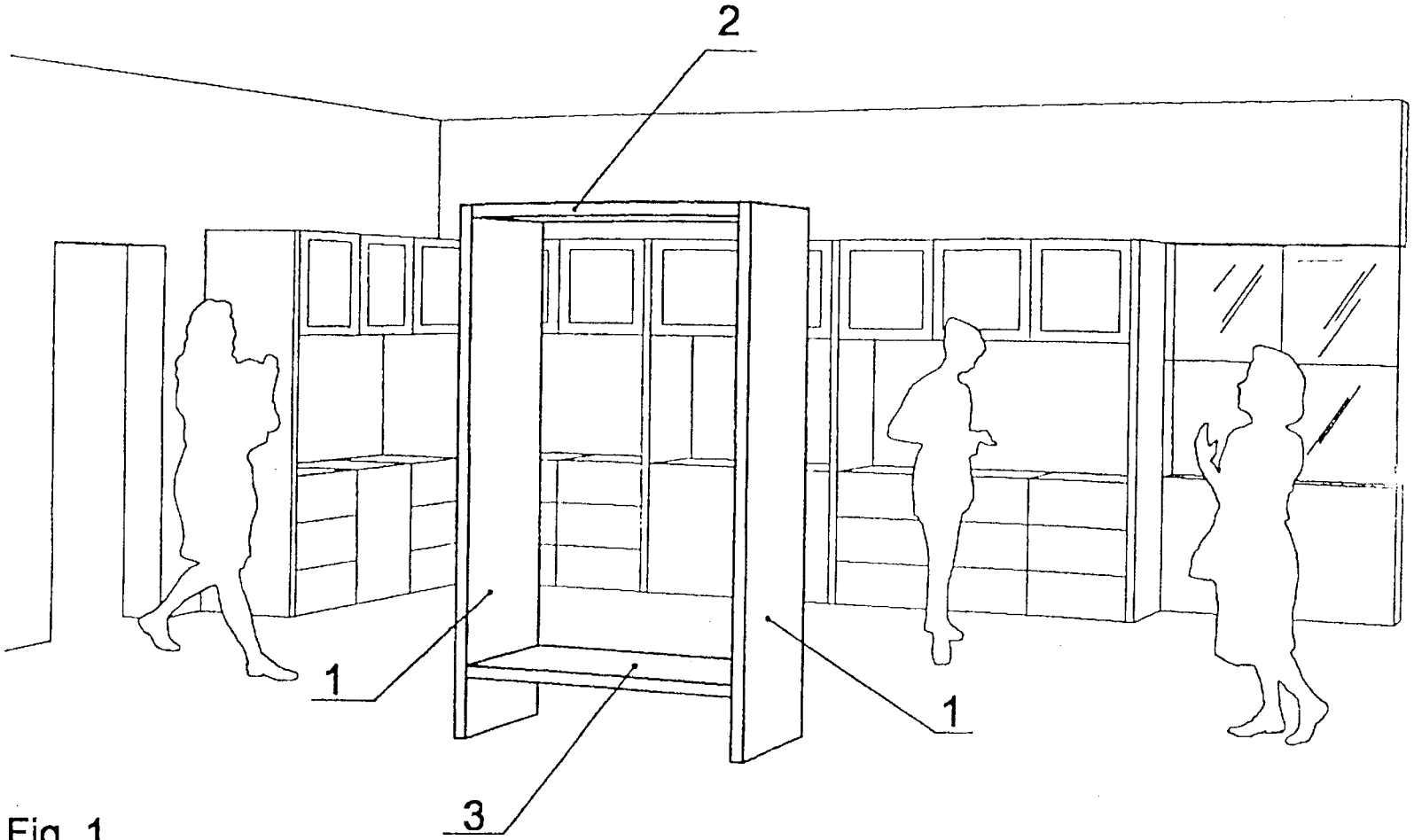

The present invention relates to the technology of modular furniture as included in the international classification A47b.

STATE OF THE PRIOR ART

In the field of furnishings and interior architecture are known several kinds of modular furniture made by vertical supporting structures combined with different hanging components attached to the peripheral brick walls.

The patent documentation resulting from a specific search, aimed at highlighting the novelty requirements and the inventive step of the invention object of the present, shows some kinds of structures consisting in vertical jambs and hanging components that are directly attached and overhanging from the walls.

It is known that during the setting up of hanging components it is always necessary to disturb the integrity of the brick walls upon which the special anchoring supports are to be fixed. During the disturbance of the walls there is the actual risk of damaging conduits for commodities such as the telephone, electricity, television, water and gas. It is obvious that once the supports are fixed on the walls, the position of the hanging components is definitive. It is also evident that the fixing position of the hanging components can't be changed to satisfy needs for new compositional layouts. Also, in the corner modular furniture, all the problems turn out to be even more difficult. It is indeed clear that, once the first installation is completed, the relative corner position can't be changed anymore.

From U.S. Pat. No. 5,794,794 there has been known a modular furniture system (column 1, lines 21 to 27) including a support structure in the form of a framework (FIG. 2) supporting modular elements of the furniture system, said support structure comprising at least two vertical jambs (column 2, lines 9 and 17 to 20). These are interconnected at each end by a top horizontal panel 100 and by a horizontal bottom element, respectively (column 2, line 10), a plurality of horizontal elements being mounted between the vertical jambs at various intermediate heights (column 2, lines 43 to 46). Where shelves or work surfaces are to support electronic equipment, horizontal elements (cross-members) with an opening to their rear normally closed by a door are provided which are secured to the vertical jambs by screws engaging bores after removal of the associated plates (column 2, lines 60 to 64 and column 2, lines 48 to 51). No supporting function of the horizontal elements has been described and they cannot exert such since the said fastening to the vertical jambs by small screws is not able to give sufficient strength to the horizontal elements. Hence no mention of strength or bending resistance has been indicated for the horizontal elements, rather the desired strength has been indicated for the vertical jambs (column 2, lines 17 to 21) these latter being the supporting elements. The horizontal elements are mere cable boxes.

Furthermore consequently in U.S. Pat. No. 5,794,794 no mention has been made of that the horizontal elements can serve for direct hanging of hanging components. Beyond the lack of strength a further reason for this is that the horizontal elements occupy such a depth that components could not be hung therein along the entire length of the space between the vertical jambs (figures, particularly FIG. 2). They are mere shelf plates.

Moreover in U,S. Pat. No. 5,794,794 the lower horizontal element itself is not constructed in such a way that it could support the furniture system so that it could maintain its position without anchorage to the wall. Rather without the legs and the roll-out shelf it would turn upside down forward.

It adds the visual-esthetic impression because of which the furniture system of U.S. Pat. No. 5,794,794 is only for stock-rooms. From U.S. Pat. No. 5,795,041 there has been known a television receiving cabinet structure for receiving a television set therein of a wide range of sizes including a pair of relatively adjustable, space-apart towers defining a television set receiving area between the adjustable, spaced-apart towers, an adjustable bridging element spanning the towers determining the horizontal distance between the towers. The adjustable bridging element includes a center member and at least one shiftable end member, whereby the length of the adjustable bridging element may be adjusted by moving at least one of the adjustable end members relative to the center member.

The problem still to be solved is to realize a modular furniture system that could be placed even far from the side walls and that is arranged so that it can be set up with hanging components whose installation doesn't require any disturbing of the integrity of the peripheral brick walls.

Another kind of problem still to be solved is to adjust the overall length and the angle of pieces of furniture composed by multiple modular structures connected to each other.

The improvements suggested by the present invention offer a global solution to all the typical problems of traditional modular furniture and allow to realize, in an affordable and convenient manner, some adjustable compositions, that can be set up without disturbing the integrity of the peripheral brick walls.

The above has been solved by the invention the subject-matter of which is a modular furniture system including a support structure in the form of a framework of modular elements said support structure comprising at least two vertical jambs, these being interconnected by a top horizontal panel and by a horizontal bottom element below and by a plurality of horizontal elements at various intermediate heights of the vertical jambs, respectively, characterized by that a) the intermediate horizontal elements are supporting ones being suspension and fixing beams with a strength, stiffness and a bending resistance adapted for directly hanging components for setting up different furniture composition without the need for devices to anchor the components to the peripheral walls of the room and b) the horizontal bottom element below is a base panel. This latter is able to support the furniture system without legs.

Contrary to U.S. Pat. No. 5,794,794 in the modular furniture system according to the invention the horizontal elements have the necessary strength, stiffness and bending resistance for supporting furniture components. Furthermore the horizontal elements can be so little deep that there is space past them for the hanging components and with it also along the entire length of the space. And that without additional parts, such as shelves. In front all can be free from additional equipment. Moreover the furniture system according to the invention is furniture-like and thus also usable for private kitchens and living-rooms.

The invention is now disclosed by the following detailed description, with reference to the Aschematic figures of the attached drawing, presented as not limiting example.

FIG. 1 is a shematic representation of a basic supporting structure, for a modular piece of furniture, made by vertical jambs connected by a horizontal top panel and a horizontal base panel.

Figure 2:
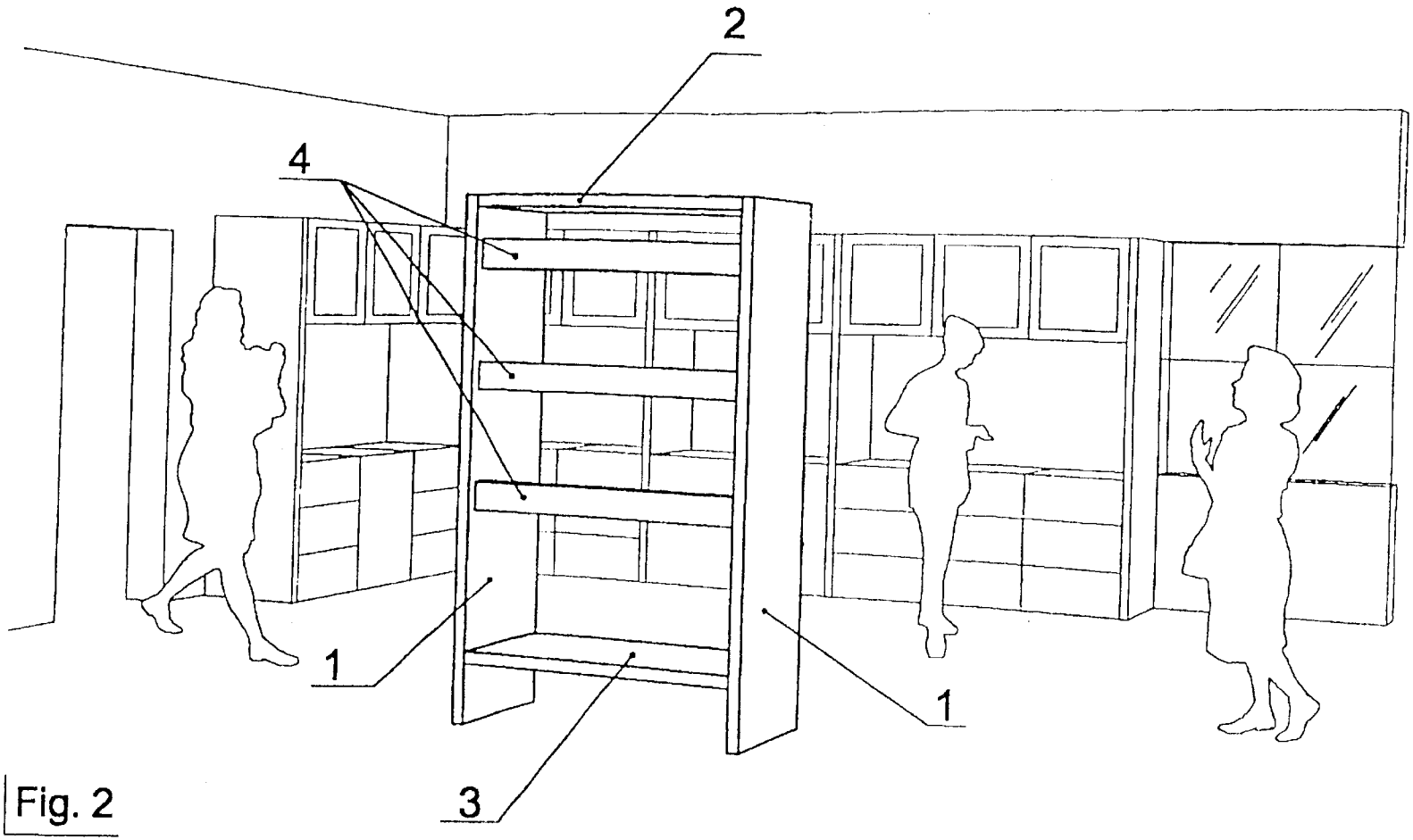

FIG. 2 represents the same supporting structure as in FIG. 1, completed with supporting horizontal elements that are meant to sustain the hanging equipment to set up modular furniture, closets, shelves, kitchens and other kinds of furnishings. In FIG. 2 one can notice the presence of horizontal supporting elements fixed with their ends at varying heights upon the vertical jambs of the basic structure of FIG. 1.

One should notice that the modular structure is displayed standing in the middle of the space and not leaning against the peripheral walls to highlight the original own characteristics of the invention, which is to allow to hang onto the horizontal supporting beams the hanging equipment that in modular traditional furniture must necessarily be applied and fixed upon the peripheral. It is thus clear that such feature facilitates the setting up and allows to operate with compositional freedom that allows the utilization of interior design allowing for more creativity in such field.

Figure 3:
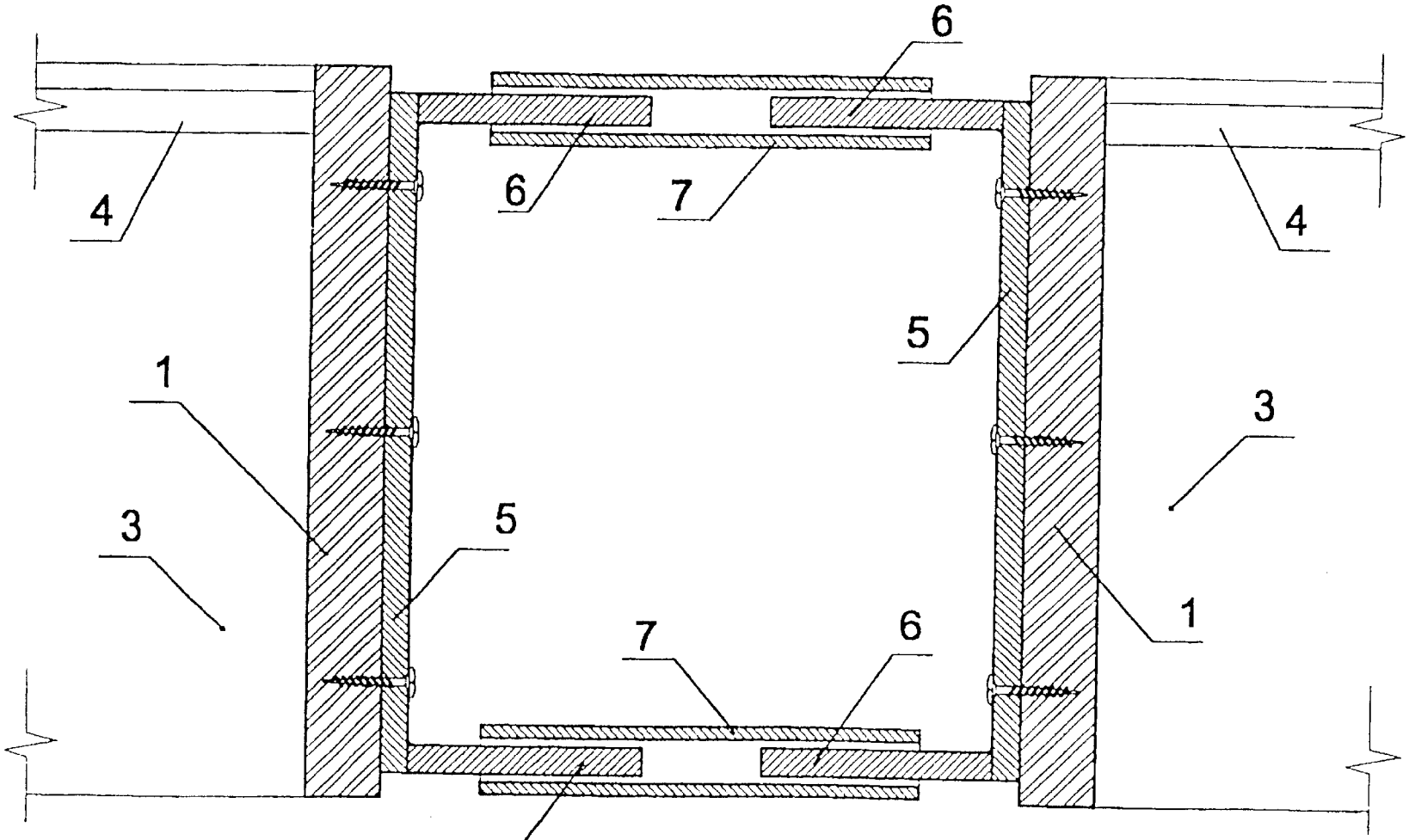

FIG. 3 represents a horizontal section of a connection element adjustable to connect the jambs of aligned basic structures. In this figure is schematically indicated the connecting element which is externally applied to the vertical jambs of aligned basic structure, but is evident that similar connecting elements can link even basic structures that are not aligned, that is laid out at different angles. In FIG. 3 one can also notice that the connecting elements are telescopically adjustable.

Figure 4:
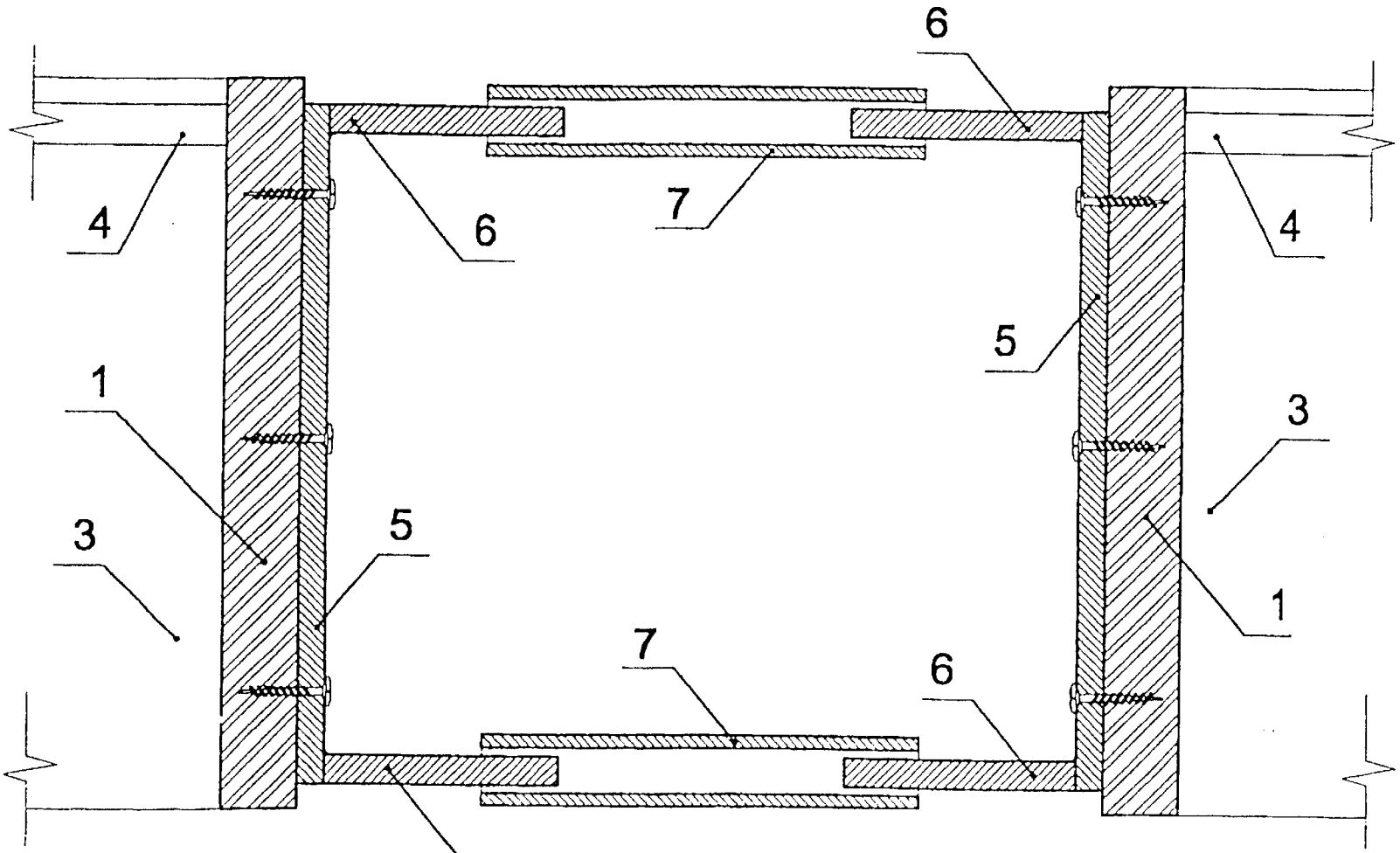

In FIG. 4 the same structures as in FIG. 3 are schematized, but they are placed at a greater distance.

FIG. 4A is an isolated view of the connecting elements of a system in which the connecting elements have a curved shape.

It should be brought to attention the fact that in FIGS. 1 and 2 the represented room is a kitchen with peripheral brick walls that are traditionally equipped, that is composed by hanging equipment applied onto the walls: such graphic representation is meant to highlight the nature of the improvements object of the present invention that allow the realization of kitchens or other furniture without intervene on the structure of the peripheral brick walls of the room.

In the FIGS. 3 and 4 straight connecting elements are represented, but it is evident that such connecting elements could have different shapes, angular and curving, to satisfy different needs resulting from the architectural style of the furnishing. An example of connecting elements having a curved shape is shown in FIG. 4A. It is also evident that the connecting adjustable elements represented in plan in the FIGS. 3 and 4 can be equipped with shelves or other accessories for aesthetic or functional purposes.

In the figures every single detail is marked as follows:

1 indicates the vertical jambs of the basic structure;

2 indicates the connecting panel at the top of the vertical jambs;

3 indicates the connecting panel at the base of the vertical jambs;

4 indicates the horizontal supporting elements that link at different heights the opposite vertical jambs. It should be observed that such horizontal elements work as suspension and fixing beams for hanging components to realize different furniture composition without the need for devices to anchor the components to the peripheral walls of the room.

5 indicates the anchoring plates that must be fixed at different heights to the vertical jambs.

6 indicates the shelves that are overhanging upon the anchoring wall plates.

7 indicates telescopic connection manifolds that engage the corresponding shelves overhanging from the anchoring plates; it should be pointed out that in the FIGS. 3 and 4 said telescopic manifolds are represented as straight but can of course present an angular or curved configuration to satisfy different aesthetic and compositional needs, as is demonstrated by the curved configuration shown in FIG. 4A.

The clearness of the figures discloses the functional simplicity of the invention and also points out the economy of industrial realization, together with the universality of employment in the realization of modular furniture. Such new modular furniture will be suitable to satisfy the different needs for furnishing and of interior design. The invention allows of course several variations of practical realization, as far as the structural dimensioning is concerned and as far as the technological choice of the material employed for the construction of the different characteristics parts, whose specifics must of course satisfy the different detailed needs. The supporting horizontal elements 4, for example, could be configured so that to allow the inserting, in their proximity, of electric wires or other supplies.

Every technician skilled in the art, now that he has learnt the inventive combination of the present invention, will be able to realize, without inventive effort, modular furniture that will be included in the protection sphere of the invention and will therefore have the characteristics as basically described, showed and hereinafter claimed.

What is claimed is:

1. A modular furniture system comprising a range of furniture modules from which given combinations of modular furniture may in use be assembled, and at least two support structures, each in the form of a framework for supporting such an assembled combination of constituent furniture modules, said support structures each comprising at least two vertical jambs these being interconnected by a horizontal top panel, by a horizontal bottom panel located therebelow and by a plurality of intermediate horizontal elements located at respective heights intermediate said top and bottom panels, the vertical jambs defining a depth of the framework from a front side of the framework to the rear side of the framework, wherein said intermediate horizontal elements are adapted in stiffness and bending resistance so as to support at least one furniture module, the horizontal elements being located adjacent to the rear side of the framework and a small dimension along the depth of the framework, whereby when assembled each constituent furniture module is hung directly on a respective one of said intermediate horizontal supporting elements without the system needing to be anchored to an adjoining wall, such that the furniture module may reside closer to the front side of the framework than the horizontal elements, and wherein the furniture system further includes adjustable connecting elements engageable at different heights to the outer sides of both vertical jambs so as to modularly connect adjacent support structures, and wherein the configuration of adjustable connecting elements is basically telescopic, the telescopic elements including angular and curved telescopic elements for allowing the adjustment and the registration of the angle and the overall length of multiple modular furniture.

2. A modular furniture system, according to claim 1, wherein the intermediate horizontal elements are configured such that in use electrical, telephone, television, gas or other kinds of conduit may be inserted into the different equipment of the modular furniture system.

3. A modular furniture system, according to claim 1, wherein the connecting elements include anchoring plates to be fixed at different heights to the outside of the vertical jambs, shelves that are supported at the anchoring plates and project therefrom, and telescopic manifold engaging the shelves of different support structures.

4. A modular furniture system comprising a range of furniture modules from which given combinations of modular furniture may in use be assembled, and at least two support structures, each in the form of a framework for supporting such an assembled combination of constituent furniture modules, said support structures each comprising at least two vertical jambs, the vertical jambs defining a depth of the framework from a front side of the framework to the rear side of the framework, and these being interconnected by a horizontal top panel, by a horizontal bottom panel located therebelow and by a plurality of intermediate horizontal elements located at respective heights intermediate said top and bottom panels wherein said intermediate horizontal elements are adapted in stiffness and bending resistance so as to support at least one furniture module, the horizontal elements being located adjacent to the rear side of the framework and a small dimension along the depth of the framework, whereby when assembled each constituent furniture module is hung directly on a respective one of said intermediate horizontal supporting elements without the system needing to be anchored to an adjoining wall such that the furniture module may reside closer to the front side of the framework than the horizontal elements, and wherein the furniture system further includes adjustable connecting elements engageable at different heights to the outer sides of both vertical jambs so as to modularly connect adjacent support structures, and wherein the configuration of adjustable connecting elements is basically telescopic for allowing the adjustment and the registration of the angle and the overall length of multiple modular furniture, wherein the connecting elements include anchoring plates to be fixed at different height to the outside of the vertical jambs, shelves that are supported at the anchoring plates and project therefrom, the telescopic elements engaging the shelves of different support structures.

* * * * *